US005895159A

United States Patent [19]

Liou

[11] Patent Number: 5,895,159

[45] Date of Patent: Apr. 20, 1999

[54] HEAT-MELTING GLUE GUN

[76] Inventor: Ferng-Jong Liou, No. 361-1, Jong-Shing Road, Sec. 2, Dah-Lii City, Taichung Hsien, Taiwan

[21] Appl. No.: 08/989,221

[22] Filed: Dec. 12, 1997

[51] Int. Cl.[6] ..... A46B 11/08; B67D 5/62

[52] U.S. Cl. ..... 401/2; 401/1; 222/113; 431/256

[58] Field of Search ..... 401/1, 2; 222/113, 222/146.2; 239/135, 139; 126/401; 431/254, 256

[56] References Cited

U.S. PATENT DOCUMENTS

| | | | |
|---|---|---|---|
| 4,755,073 | 7/1988 | Girardin et al. | 401/1 |
| 4,795,064 | 1/1989 | Sheu | 401/1 |
| 4,949,881 | 8/1990 | Watanabe et al. | 222/113 |
| 5,048,722 | 9/1991 | Liehu | 401/1 |
| 5,479,914 | 1/1996 | Tsai | 401/2 |

*Primary Examiner*—David J. Walczak
*Assistant Examiner*—Tuan N. Nguyen
*Attorney, Agent, or Firm*—Dougherty & Troxell

[57] ABSTRACT

A heat-melting glue gun including a body shell in which a heating member containing a heat-melting glue stick, a glue stick feeding means, a gas cylinder, and a current producer are mounted. A conduit pipe extends from the gas cylinder to end with a nozzle located below the heating member which is wrapped with a layer of thermal conductive net with good heat transfer ability. Wire lines having first ends connected to positive and negative electrodes of the current producer extend their second ends to points properly above the nozzle. When a flint in the current producer is struck, an instantaneous current is generated to cause a short-circuit spark to occur between the two second ends of the wire lines. Gas supplied from the gas cylinder and jetting from the nozzle is ignited by the spark to burn below the heating member, causing the glue stick in the heating member to be heat melted.

3 Claims, 2 Drawing Sheets

HEAT-MELTING GLUE GUN

BACKGROUND OF THE INVENTION

The present invention relates to an improved heat-melting glue gun which has simple and compact structure and is more convenient for use.

FIG. 1 illustrates a conventional heat-melting glue gun 10 which includes a heating member 11 receiving a heat-melting glue stick 20 therein. The heating member 11 is heated by high temperature caused by an electric resistance, so that the heat-melting glue stick 20 in the heating member is melted to bond things together.

In brief, the conventional heat-melting glue gun 10 utilizes electric resistance to produce thermal energy needed to melt the glue stick 20. To achieve this purpose, a wire 12 must be provided as an interface between the glue gun and an electric power source to produce necessary electric resistance. The wire 12 usually has limited length and therefore, an extension cord is frequently needed when a long distance exists between a socket—the electric power source—and a place at where a gluing work proceeds. Such prolonged wire will often bring inconvenience to a user of the heat-melting glue gun. Moreover, the high-temperature heating member 11 will possibly unexpectedly contact with and destroy the electric wire skin and causes exposed conductors of the wire 12. A dangerous electric shock will occur when the heated heating member 11 unexpectedly contacts with an exposed conductor.

In a worse condition, when the skin of the wire 12 is melted by the heating member 11 to expose conductors for the positive and negative electrodes and the two conductors are electrically connected through the heating member 11, a serious short circuit will occur to injure the user and even cause a fire.

Another disadvantage existing in such conventional heat-melting glue gun is that a very high power consumption is needed to produce thermal energy through electric resistance. This is, of course, unacceptable from an energy-saving point of view.

It is therefore tried by the inventor to develop an improved heat-melting glue gun with simple components and structure to eliminate the drawbacks existing in the conventional heat-melting glue gun.

SUMMARY OF THE INVENTION

A primary object of the present invention is to provide a heat-melting glue gun which uses burning gas instead of electric resistance to produce heat for melting the glue material in the gun. No electric wire or extension cord is needed by the glue gun to transform electric power into thermal energy.

Another object of the present invention is to provide a heat-melting glue gun which does not need an electric wire and therefore no danger of electric shock will be caused.

A further object of the present invention is to provide a heat-melting glue gun which uses burning gas to produce required thermal energy to save large consumption of electric power.

To achieve the above and other objects, the present invention provides a heat-melting glue gun mainly including a body shell into which a heating member receiving a heat-melting glue stick, a glue stick feeding means, a current producer, and a gas cylinder are mounted. The heating member is provided around an outer surface with a layer of thermal conductive net with good heat transfer ability. The gas cylinder is provided with a gas conduit pipe which extends to a point below the thermal conductive net. A nozzle is connected to an end of the gas conduit pipe below the thermal conductive net for jetting gas toward the thermal conductive net. The current producer is provided with wire lines, these wire lines have first ends connected to positive and negative electrode of the current producer and second ends extending to points above the nozzle. When the current producer is actuated to produce an instantaneous current, a short-circuit spark is produced between the two second ends of the wire lines to ignite gas jetting from the nozzle. The heating member is heated by flames of burning gas to a high temperature and melts the glue stick contained in the heating member. With the above structure, it does not need an electric wire to supply electric power to the glue gun for generating thermal energy to melt the glue stick.

DETAILED DESCRIPTION OF THE PREFERRED EMBODIMENT

Figure 1:
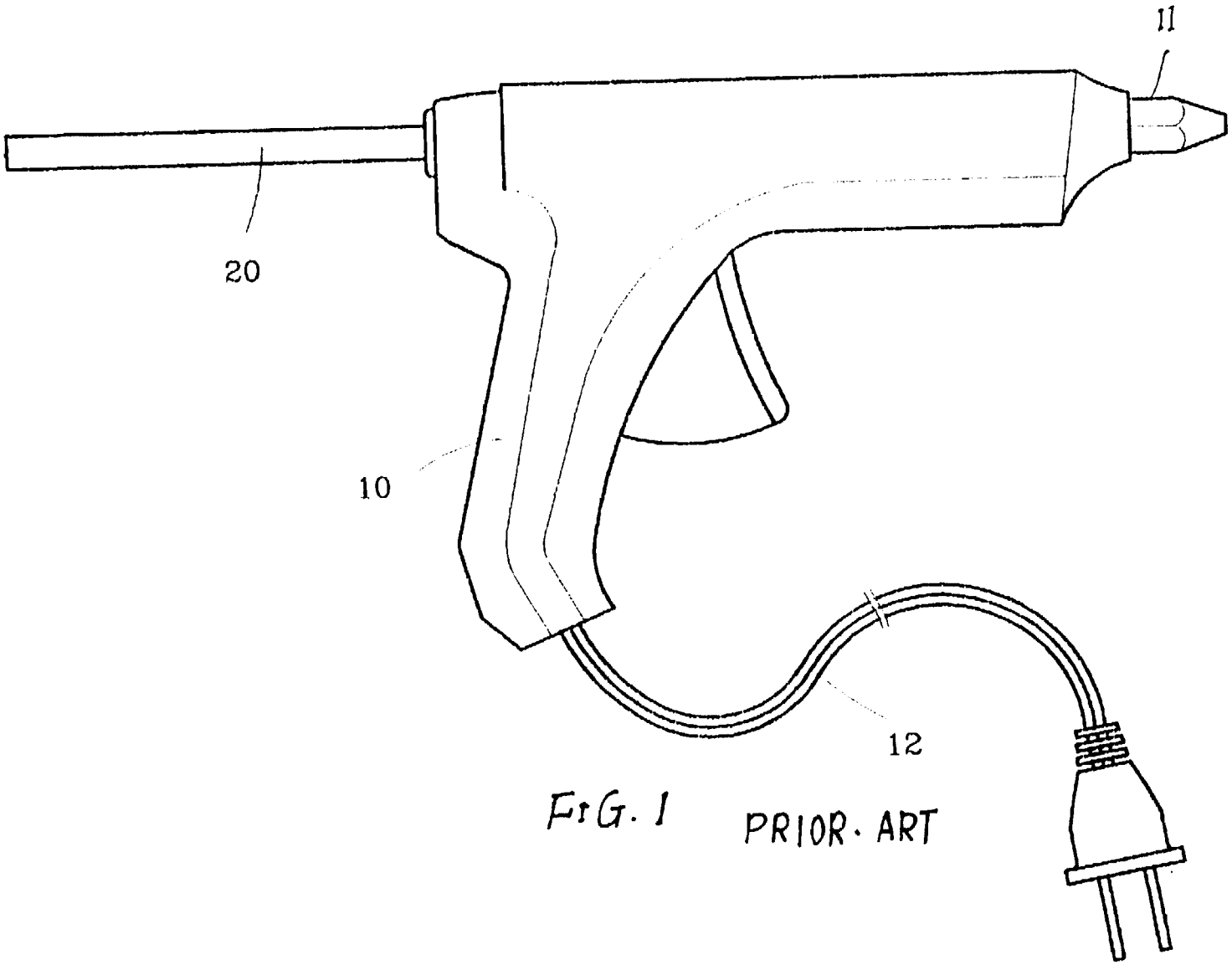
FIG. 1 PRIOR ART
FIG. 1 illustrates a conventional heat-melting glue gun.
Figure 2:
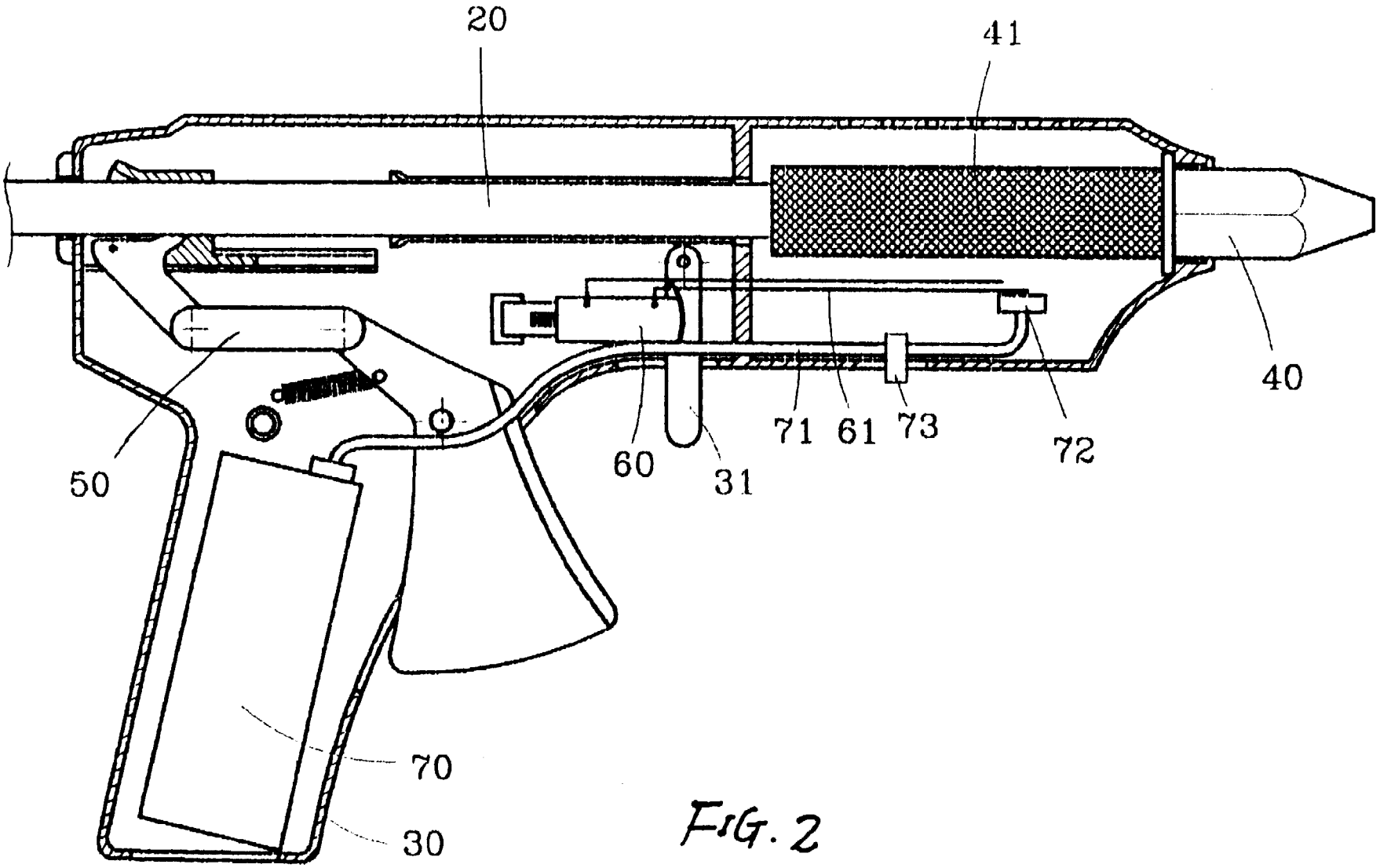
FIG. 2 is a sectional view of heat-melting glue gun according to the present invention.

Please refer to FIG. 2. The heat-melting glue gun according to the present invention mainly includes a body shell 30 into which a heating member 40, a glue stick feeding means 50, a current producer 60, and a gas cylinder 70 are mounted.

The heating member 40 is a hollow tubular member defining an inner space for receiving a heat-melting glue stick 20 therein. A layer of thermal conductive net 41 with very good heat transfer ability is provided around an outer surface of the heating member 40.

The gas cylinder 70 is mounted in a lower portion of the body shell 30. A conduit pipe 71 extends in the body shell 30 from the gas cylinder 70 to a point below the thermal conductive net 41 wrapping around the heating member 40. A nozzle 72 is connected to an end of the conduit pipe 71 below the net 41 and has an outlet facing toward the net 41. Gas in the gas cylinder 70 can be guided by the conduit pipe 71 and the nozzle 72 to jet toward the thermal conductive net 41. A valve 73 is provided on the conduit pipe 71 at a predetermined position to control the supply or disconnection of the gas.

The current producer 60 has an internal flint at an impacting end thereof. A pressing bar 31 is provided on the body shell 30 near the impacting end of the current producer 60. When a force is applied on the pressing bar 31 to strike the flint in the current producer 60 with the pressing bar 31, an instantaneous electric current is produced. Wire lines 61 are provided in the gun shell 30 with their first ends connected to positive and negative electrodes of the current producer 60 and their second ends located a little above the nozzle 72. An adequate distance is left between the second ends of the wire lines 61 and the nozzle 72. When the instantaneous electric current is generated, a short-circuit spark will be produced at the second ends of the wire lines 61 to ignite gas jetting from the nozzle 72.

The glue stick feeding means 50 includes a set of links. The glue stick 20 is coupled with a top link of the feeding means 50, so that the glue stick 20 is slowly fed into the heating member 40 through operation of the glue stick feeding means 50.

To use the heat-melting glue gun of the present invention, first open the valve 73, so that gas jets from the nozzle 72.

Then, apply a force on the pressing bar 31 to strike the flint in the current producer 60 to generate an instantaneous electric current which results in a short-circuit spark between two second ends of the positive and the negative electrode wire lines 61 above the nozzle 72. The short-circuit spark immediately ignites the gas jetting from the nozzle 72. The burning gas heats the thermal conductive net 41 to a high temperature. The heat is transferred to the heating member 40 and melts the glue stick 20 in the heating member 40 into liquid viscous glue suitable for adhesively bonding two articles together. When a gluing work is over, simply switch the valve 73 close to disconnect supply of gas to the nozzle 72.

In the present invention, since the thermal energy used to heat melting the glue stick 20 is not transformed from an electric power, it is not necessary to connect any electric wire from an electric power source to the glue gun. Therefore, the heat-melting glue gun can be more conveniently handled to proceed a gluing work at any place. Any possible risks of unexpectedly damaged electric wire skin and dangerous electric shock due to contact of the wire with the high-temperature heating member 40 can be avoided. Moreover, energy consumption by burning gas is much lower than that by producing a high electric resistance.

What is claimed is:

1. A heat-melting glue gun comprising: a body shell in which a heating member, a gas cylinder, a current producer, and a glue stick feeding device are mounted; said heating member being a hollow tubular member for receiving a heat-melting glue stick therein; said gas cylinder being mounted in a lower portion of said body shell; said current producer producing an instantaneous electric current when a force is applied on a flint inside said current producer the current producer having positive and negative electrodes; a nozzle located adjacent to and below said hollow tubular heating member said nozzle having an outlet facing toward said hollow tubular heating member; a conduit pipe connected to said gas cylinder and said nozzle so as to supply gas to said nozzle; first and second electrode wire lines connected to the positive and negative electrodes of the current producer, the electrode wire lines each having an end adjacent to the nozzle outlet, the ends being spaced apart such that a spark is produced between the ends of the first and second electrode wires when the current producer produces an electric current; a valve connected to the conduit pipe at a position displaced away from the gas cylinder; and said glue stick feeding device including a linkage for slowly pushing a glue stick coupled therewith into said heating member.

2. A heat-melting glue gun as claimed in claim 1, wherein said heating member is provided around an outer surface with a layer of thermal conductive net with high heat transfer ability.

3. A heat-melting glue gun as claimed in claim 1, wherein said glue gun is provided on said body shell with a pressing bar near an impacting end of said current producer, whereby when a force is applied on said pressing bar to strike said flint in said current producer, an instantaneous electric current is produced by the current producer.

* * * * *